US008133042B2

(12) United States Patent
Yajima

(10) Patent No.: US 8,133,042 B2
(45) Date of Patent: Mar. 13, 2012

(54) CHEMICAL LIQUID SUPPLYING APPARATUS AND PUMP ASSEMBLY

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 660 days.

(21) Appl. No.: 12/274,437

(22) Filed: Nov. 20, 2008

(65) Prior Publication Data

US 2009/0142205 A1 Jun. 4, 2009

(30) Foreign Application Priority Data

Dec. 3, 2007 (JP) ..... 2007-312164

(51) Int. Cl.
*F04B 43/00* (2006.01)
*F04B 45/02* (2006.01)

(52) U.S. Cl. ..... 417/473; 417/472; 417/476; 417/431; 417/437

(58) Field of Classification Search ..... 417/472–476
See application file for complete search history.

(56) References Cited

U.S. PATENT DOCUMENTS

| | | | | |
|---|---|---|---|---|
| 2,578,265 | A * | 12/1951 | Bartlett Saalfrank Royal | 417/63 |
| 4,417,861 | A | 11/1983 | Tolbert | |
| 4,886,432 | A | 12/1989 | Kimberlin | |
| 4,947,491 | A * | 8/1990 | Parkinson et al. | 4/321 |
| 5,167,837 | A | 12/1992 | Snodgrass et al. | |
| 6,183,223 | B1 | 2/2001 | Yajima | |
| 6,193,783 | B1 | 2/2001 | Sakamoto et al. | |

FOREIGN PATENT DOCUMENTS

| | | | |
|---|---|---|---|
| JP | 10-61558 | | 3/1998 |
| JP | 2000-12449 | | 1/2000 |
| JP | 2000015168 | A | 1/2000 |
| JP | 2004-50026 | | 2/2004 |
| JP | 2006-144741 | | 6/2006 |
| JP | 2006200464 | A | 8/2006 |
| JP | 2006266250 | A | 10/2006 |
| JP | 2008128059 | A | 6/2008 |
| JP | 2008133800 | A * | 6/2008 |

OTHER PUBLICATIONS

Machine translation of JP 2006-266250 A.*

* cited by examiner

*Primary Examiner* — Nimeshkumar Patel
*Assistant Examiner* — Jose M Diaz
(74) *Attorney, Agent, or Firm* — McCormick, Paulding & Huber LLP

(57) ABSTRACT

A chemical liquid supplying apparatus, which can discharge chemical liquid with high precision, is provided. A pump assembly is detachably mounted in a pump case in which liquid inflow and discharge ports are formed. The pump assembly includes: a cylindrical body in which a piston is slidably incorporated axially; an elastically deformable bellows forming a pump chamber in the pump case and forming a drive chamber in which an indirect medium is enclosed; and an axially elastically-deformable bellows cover continuing with a sliding surface of the piston and forming a seal chamber in which the indirect medium is enclosed, and the pump assembly is unitized. The pump assembly is coupled to a drive shaft via a connecting member, and by axial-directional reciprocating movement of this drive shaft, the piston causes the bellows to perform a pump operation, whereby the chemical liquid is discharged from a liquid discharge portion.

12 Claims, 8 Drawing Sheets

CHEMICAL LIQUID SUPPLYING APPARATUS AND PUMP ASSEMBLY

CROSS-REFERENCE TO RELATED APPLICATIONS

Applicant hereby claims foreign priority benefits under U.S.C. §119 from Japanese Patent Application No. 2007-312164 filed on Dec. 3, 2007, the contents of which are incorporated by reference herein.

TECHNICAL FIELD OF THE INVENTION

The present invention relates to a chemical liquid supplying apparatus and a pump assembly, which discharge a fixed amount of chemical liquid such as photoresist liquid.

BACKGROUND OF THE INVENTION

On surfaces of semiconductor wafers, glass substrates for liquid crystal display device, or the like, minute circuitry patters are formed by a photolithography step and an etching step. In the photolithography step, a chemical liquid supplying apparatus is used to apply chemical liquid such as photoresist liquid onto the surfaces of the wafers or glass substrates, and the chemical liquid accommodated in a container is sucked up by a pump and passes a filter and the like to be applied onto applied materials such as wafers by a nozzle. Patent Document 1 (Japanese Patent Application Laid-Open Publication No. 2000-12449) discloses a processing liquid supplying apparatus for supplying wafer photoresist liquid, and Patent Document 2 (Japanese Patent Application Laid-Open Publication No. 2004-50026) discloses a coating apparatus for supplying photoresist liquid onto glass substrates for liquid crystal display device.

In such a chemical liquid supplying apparatus, when particles such as dust coexist in the applied chemical liquid, they adhere to the applied materials and cause a pattern defect, whereby a yield of products is decreased. When the chemical liquid in the container accumulates in the pump, it is changed in quality, and the chemical liquid changed in quality becomes particles in some cases. Therefore, it has been demanded that the chemical liquid is not accumulated in the pump that discharges the chemical liquid.

Used as the pump that discharges the chemical liquid is a pump, in which a pump chamber into which the chemical liquid flows and a drive chamber that expands and contracts the pump chamber are partitioned by a partition film such an elastically deformable diaphragm or tube. Indirect liquid, i.e., an incompressible medium is filled with the drive chamber, whereby the chemical liquid is intended to be pressurized via the partition film. A pressurization method of the incompressible medium includes a bellows type as described in Patent Document 3 (Japanese Patent Application Laid-Open Publication No. 10-61558), and a syringe type of using a piston as shown in Patent Document 4 (U.S. Pat. No. 5,167,837).

A reciprocating pump for discharging liquefied gas includes, as described in Patent document 5 (Japanese Patent Application Laid-Open Publication No. 2006-144741), a type of using a bellows to seal fluid in the piston from the outside.

SUMMARY OF THE INVENTION

When a pump operation is performed by elastically deforming the diaphragm or tube by the incompressible medium, it is possible to prevent the chemical liquid from being accumulated in a expansion/contraction chamber of the pump and to prevent occurrence of the particles caused by the accumulation of the chemical liquid. However, at the same time, the incompressible medium plays an important role of determining performance of the pump. In other words, when air enters into the incompressible medium from the outside, incompressibility of the incompressible medium is lost macroscopically, and movement of the bellows or piston cannot be precisely transmitted to the diaphragm or tube, whereby a movement stroke of the bellows or piston does not correspond to a discharge amount of the chemical liquid. In addition, similarly to the above even when the incompressible medium leaks out, the movement strokes of the bellows and the like do not correspond to the discharge amount of the chemical liquid, whereby it becomes impossible to discharge the chemical liquid with high precision.

In the pump of the syringe type shown in Patent Document 4 described above, normally, a seal member that contacts with an outer circumferential surface of the piston is provided in a cylinder, and a region between an interior of the drive chamber located on a tip surface side of the piston and the outside that is on a base end surface side of the piston is sealed, whereby the piston reciprocates, by regarding the seal member as a boundary, between a portion in which the incompressible medium exists and the outside. For this reason, the incompressible medium may be exposed to the outside in a state of adhering to the outer circumferential surface of the piston. Because the adhered incompressible medium becomes a thin film to enter into a region between the outer circumferential surface of the piston and the seal member, it prevents the seal material from directly contacting with the outer circumferential surface of the piston and plays a role as lubricant. However, at the same time, the incompressible medium exposed to the outside disappears from a surface of the piston due to partially gradual evaporation or drying of the incompressible medium, whereby an amount of the incompressible medium decreases. In addition, when the incompressible medium exposed to the outside volatilizes, since the incompressible medium functioning as lubricant disappears from the outer circumferential surface of the piston and becomes in a state where an oil film runs out, the seal member contacts directly with the outer circumferential surface of the piston, which results in progress of abrasion of the seal member.

When the piston is moved backward in order to expand the drive chamber partitioned by the partition film and suck the chemical liquid present in the container into the pump chamber, since the incompressible medium becomes in a negative pressure state, exterior circumambient air may enter into the incompressible medium present in the drive chamber from a region between the outer circumferential surface of the piston and an inner circumferential surface of the cylinder. This phenomenon becomes significant when the seal member that is slid on and contacts with the outer circumferential surface of the piston is abraded and its sealing characteristic decreases. This is also true even when large negative pressure is applied to the incompressible medium by the piston.

In contrast, in the pump of the bellows type mentioned above, since the seal member that contacts with a sliding surface is not used, there is the advantage that a sealing characteristic of the drive chamber with which the incompressible medium is filled and a hermetic property of a pump chamber which pressurizes the chemical liquid are high. However, there is such a tendency that pressure applied to the incompressible medium in the bellows type is lower than that in the syringe type. For example, when resist is discharged to a nozzle via a filter, it is necessary to increase the pressure of the pump chamber because flow resistance of the filter is large. For this reason, when the bellows is driven, the pressure of the incompressible medium in the drive chamber increases, and the bellows may slightly expand radially. If the bellows expands, the movement stroke of the bellows and the discharge amount of the chemical liquid do not correspond to each other with high precision.

In order to increase discharge pressure from the pump, the pump of the syringe type mentioned above is preferable. However, when the abrasion of the seal member progresses, the incompressible medium in the drive chamber may leak out to the outside. For this reason, the seal member is regularly replaced. Also in a chemical liquid discharging pump of such a type that, without using the seal member, a gap between the outer circumferential surface of the piston and the inner circumferential surface of the cylinder is made narrow to prevent a leakage of the incompressible medium in the drive chamber, similarly to the foregoing description, when the abrasion of the sliding surface between the piston and the cylinder progresses, since the incompressible medium in the drive chamber leaks out to the outside, it is necessary to replace the piston and the cylinder.

An object of the present invention is to provide a chemical liquid supplying apparatus and a pump assembly, which can discharge chemical liquid with high precision.

Another object of the present invention is to provide a chemical liquid supplying apparatus and a pump assembly, in which an incompressible medium does not leak out from a region between a piston and a cylindrical body that guides the piston.

Still another object of the present invention is to provide a chemical liquid supplying apparatus and a pump assembly, which can improve a lubrication characteristic of a seal member by interposing a film of an incompressible medium in the seal member that seals a region between a piston and a cylindrical body.

A chemical liquid supplying apparatus according to the present invention comprises: a pump case having a liquid inflow port and a liquid discharge port formed therein; a cylindrical body mounted in the pump case, and incorporating an axially reciprocable piston therein; an elastically deformable bellows attached to a tip portion of the cylindrical body, and partitioning and forming a pump chamber communicating with the liquid inflow port and the liquid discharge port in the pump case, the bellows partitioning and forming a drive chamber in which an incompressible indirect medium is enclosed between a tip of the piston and the bellows; a flexible cover member elastically deformed axially, attached between a base end portion of the piston and the cylindrical body, and forming a seal chamber which continues with a sliding surface of the piston and in which the incompressible indirect medium is enclosed; and a drive unit mounted in the pump case, a drive shaft for reciprocating axially the piston being incorporated in the drive unit.

The chemical liquid supplying apparatus according to the present invention further comprises a connection rod provided to the piston, being smaller in diameter than the piston, and coupling the piston and a tip portion of the bellows. In the chemical liquid supplying apparatus according to the present invention, the piston includes a piston main body portion contacting with an inner circumferential surface of the cylindrical body, and a base end portion smaller in diameter than the piston main body portion, and the seal chamber is formed between the flexible cover member and the base end portion.

The chemical liquid supplying apparatus according to the present invention is such that an average effective diameter of the bellows is substantially identical to an outer diameter of the piston main body portion. Also, the chemical liquid supplying apparatus according to the present invention is such that an average effective diameter of the flexible cover is substantially identical to an outer diameter of the piston main body portion. Further, in the chemical liquid supplying apparatus according to the present invention, the flexible cover is a bellows or diaphragm.

A pump assembly according to the present invention is a pump assembly detachably mounted in a pump case having a liquid inflow port and a liquid discharge port formed therein, the pump assembly comprising: a cylindrical body incorporating an axially slidable piston therein; an elastically deformable bellows attached to a tip portion of the cylindrical body, and partitioning and forming a drive chamber in which an incompressible indirect medium is enclosed between a tip of the piston and the bellows; and a flexible cover member elastically deformed axially, attached between a base end portion of the piston and the cylindrical body, and forming a seal chamber which continues with a sliding surface of the piston and in which the incompressible indirect medium is enclosed, wherein a pump chamber is formed by the bellows and the pump case in a state of being mounted in the pump case.

The pump assembly according to the present invention further comprises a connection rod provided to the piston, being smaller in diameter than the piston, and coupling the piston and a tip portion of the bellows. In the pump assembly according to the present invention, the piston includes a piston main body portion contacting with an inner circumferential surface of the cylindrical body, and a base end portion smaller in diameter than the piston main body portion, and the seal chamber is formed between the flexible cover member and the base end portion.

The pump assembly according to the present invention is such that an average effective diameter of the bellows is substantially identical to an outer diameter of the piston. Also, the pump assembly according to the present invention is such that an average effective diameter of the flexible cover is substantially identical to an outer diameter of the piston main body. Further, in the pump assembly according to the present invention, the flexible cover is a bellows or diaphragm.

According to the present invention, the drive chamber in which the incompressible indirect medium is enclosed is formed in the bellows partitioning the pump chamber and the drive chamber, and the indirect medium is pressurized by the piston to expand and contract axially the bellows and perform a pump operation, so that high pressure can be added to the indirect medium by the piston. Therefore, even if high flow resistance is applied to the pump chamber during contraction of the pump chamber, the chemical liquid can be supplied.

By the flexible cover member such as a bellows cover provided between the piston and the cylindrical body, the seal chamber continuing with the sliding surfaces of the piston and the cylindrical body is formed, and the incompressible indirect medium is enclosed in the seal chamber. Because the flexible cover member for forming the seal chamber has no sliding portion, it is possible to completely prevent a leakage of the indirect medium from the flexible cover member. Therefore, even if the indirect medium inside the apparatus leaks out from a sliding portion between the piston and the cylindrical body when pressure in the pump chamber is made high, the indirect medium flows into the seal chamber, so that the indirect medium is prevented from leaking out outside the chemical liquid supplying apparatus and/or the pump assembly.

Thus, because the sliding portion between the piston and the cylindrical body continues with (or is contacted or connected with or follows) the seal chamber, the incompressible medium is filled on both axial-directional sides of a boundary as which the seal member for sealing a region between the piston and the cylindrical body is regarded, so that the indirect medium which has become a thin-film shape is interposed in the seal member and a portion contacting with the seal member, whereby a lubrication characteristic of the seal member is increased, and abrasion of the seal member is prevented. Therefore, durability of the seal member can be improved.

Even if the indirect medium in the seal chamber enters into the drive chamber due to the fact that pressure in the drive chamber has become lower than that in the seal chamber by driving the piston in a direction of contracting the bellows, because compressible fluid such as air is not mixed into the drive chamber, it is possible to make a movement stroke of the piston and a deformation amount of the pump chamber correspond to each other with high precision, whereby a discharge amount of the chemical liquid from the pump can be made highly precise.

Because the seal chamber continuing with the drive chamber via the sliding portion is partitioned and formed by the flexible cover member such as a bellows cover, even if the seal member provided to the sliding portion between the piston and the cylindrical body is abraded due to a secular change, mixture of the gas into the drive chamber is prevented. Therefore, it is possible to set a replacement time and a maintenance time of the seal member longer and to improve the durability of the chemical liquid supplying apparatus.

When a gap between the piston and the cylindrical body is set narrow like a syringe to have a sealing effect without using the seal member, there is the advantage of causing the chemical liquid to be stably discharged without generating stick-slip peculiar to the seal member. Generally, there is the following drawback, i.e., if the seal member is not used, a leakage of the indirect medium and/or mixture of the gas into the drive chamber occur easily, and its seal characteristics deteriorate. However, since the seal chamber is formed by the flexible cover member provided between the piston and the cylindrical body, it is possible to eliminate the above drawback and to improve the durability of the chemical liquid supplying apparatus while a stable discharge of the chemical liquid is maintained.

Because the pump assembly unitized by the bellows, the cylindrical body, and the flexible cover member is detachably mounted in the pump case, it is possible to easily perform attaching and detaching operations of the pump assembly, and to carry out maintenance and/or replacement work of the pump assembly in a short time.

DESCRIPTION OF THE PREFERRED EMBODIMENTS

Figure 1:
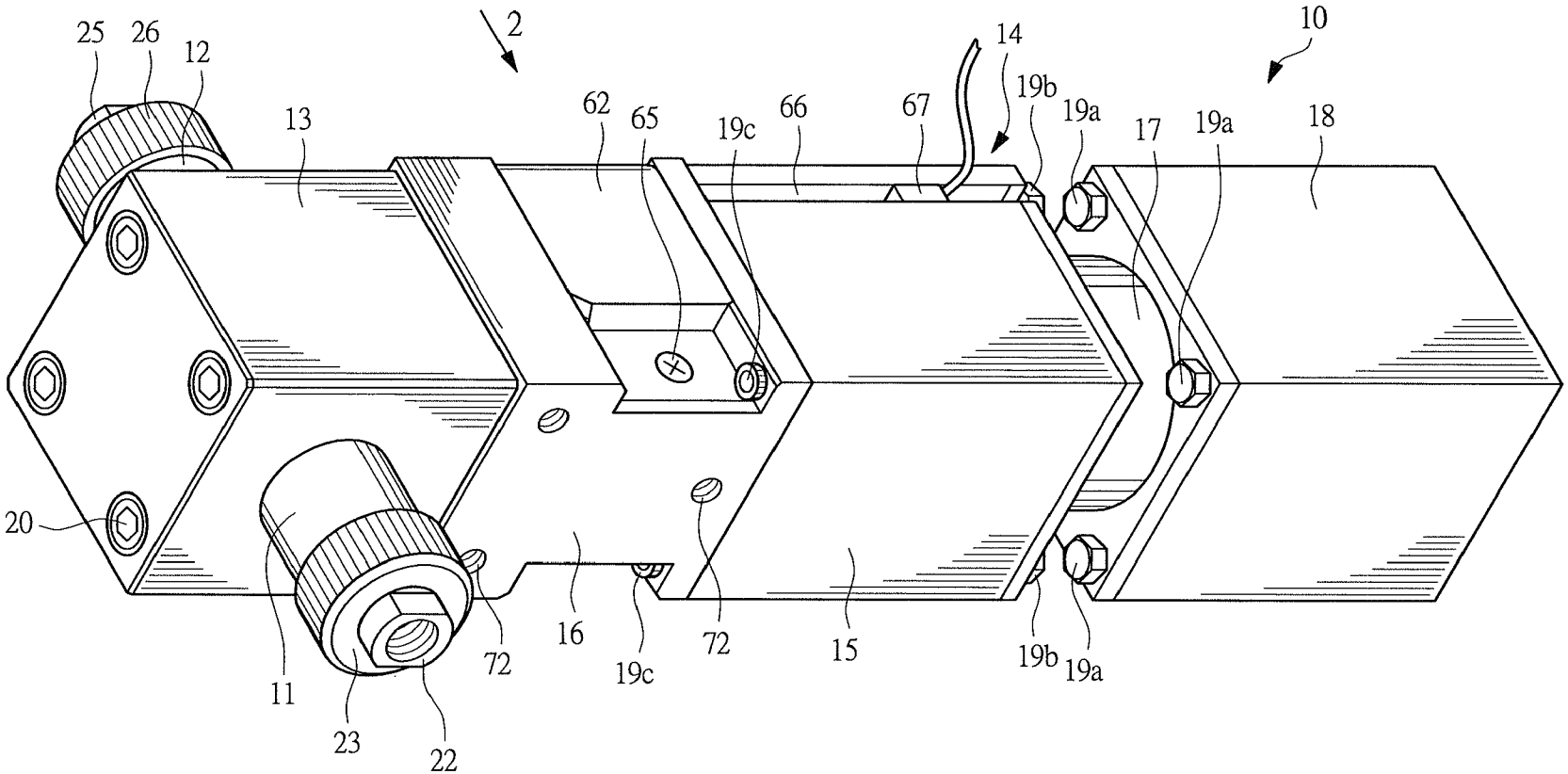
FIG. 1 is a perspective view showing external appearance of a chemical liquid supplying apparatus according to an embodiment of the present invention.
Figure 2:
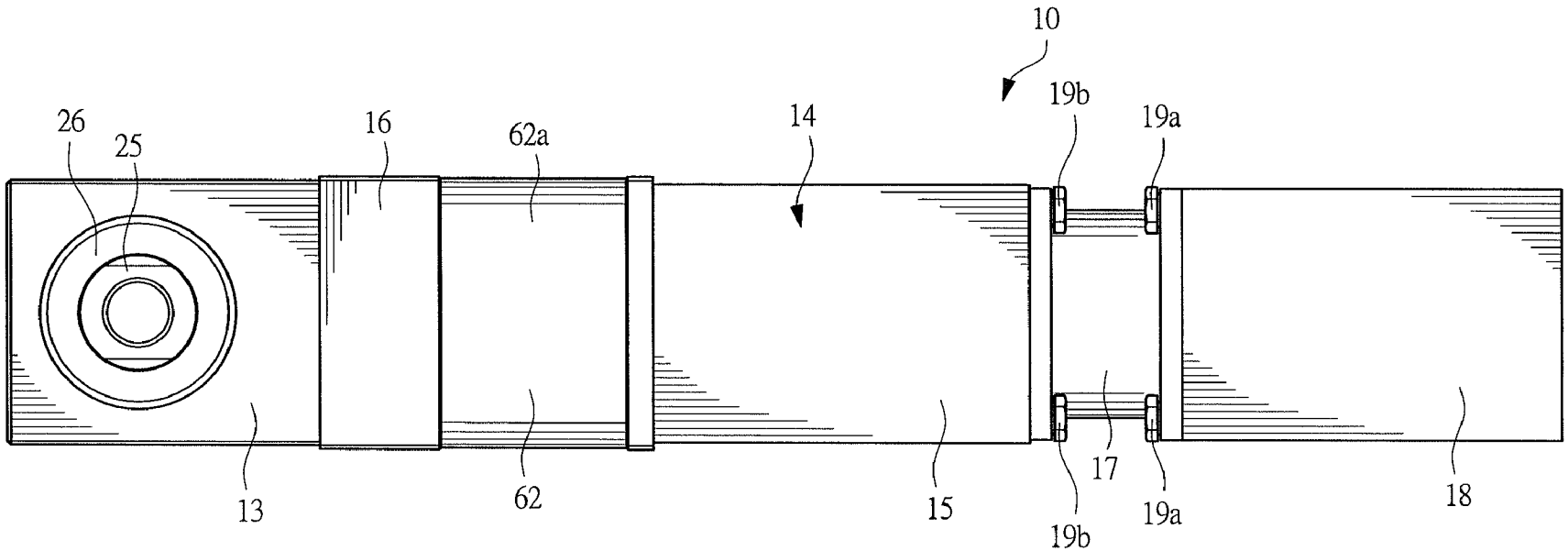
FIG. 2 is a plane view of the chemical liquid supplying apparatus viewed from an arrow 2 in FIG. 1.
Figure 3:
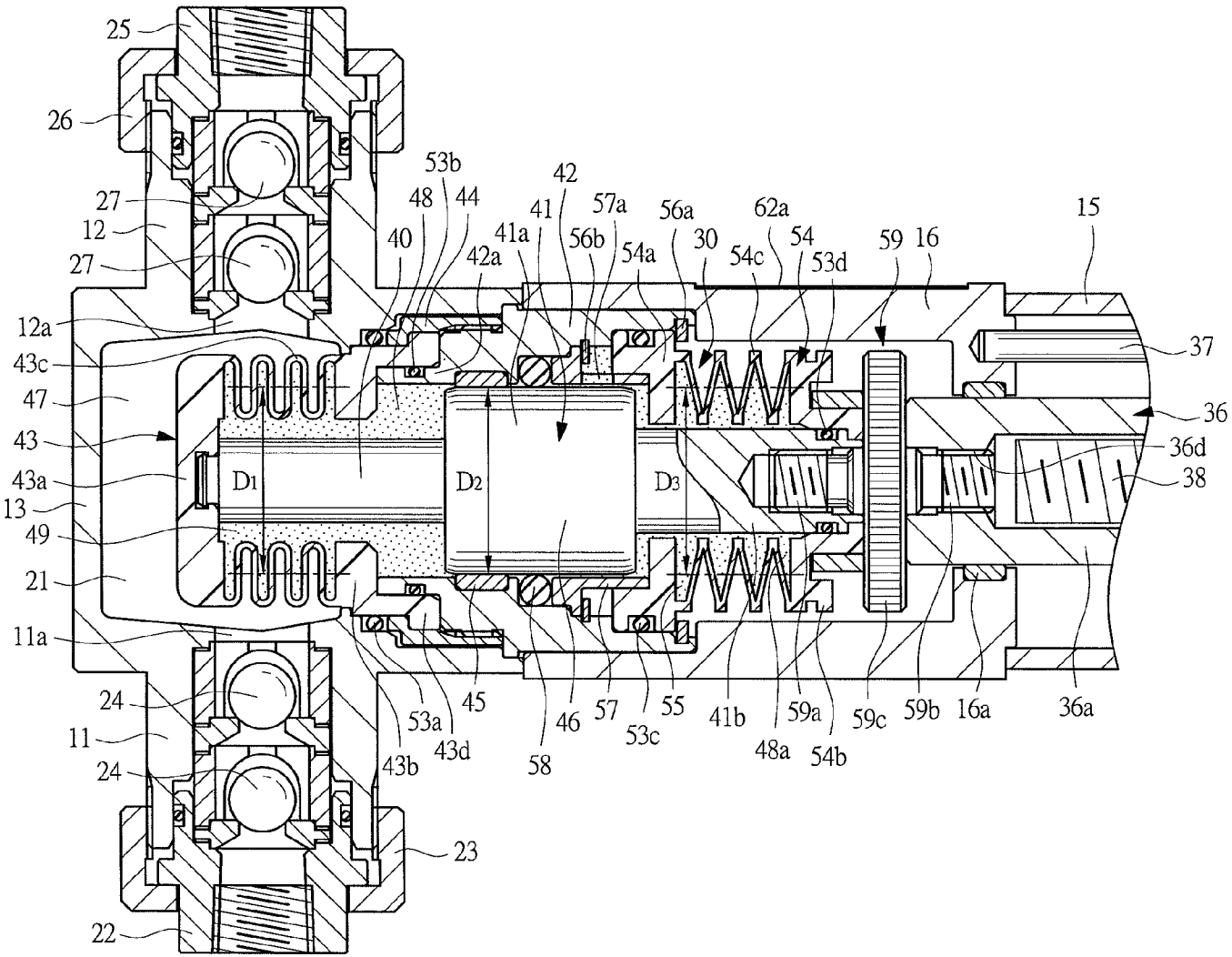
FIG. 3 is an enlarged sectional view showing a portion of a front-side half of FIG. 1.
Figure 4:
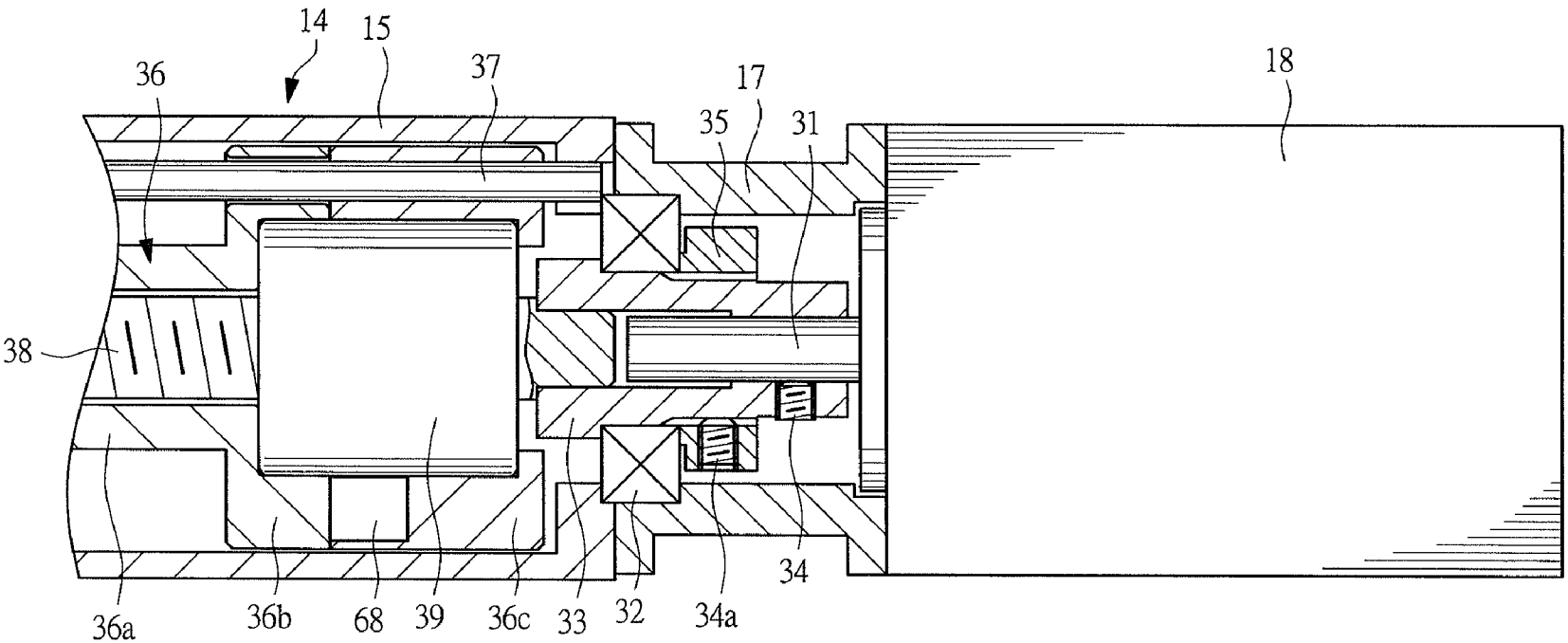
FIG. 4 is an enlarged sectional view showing a rear-side half of FIG. 1.
Figure 5:
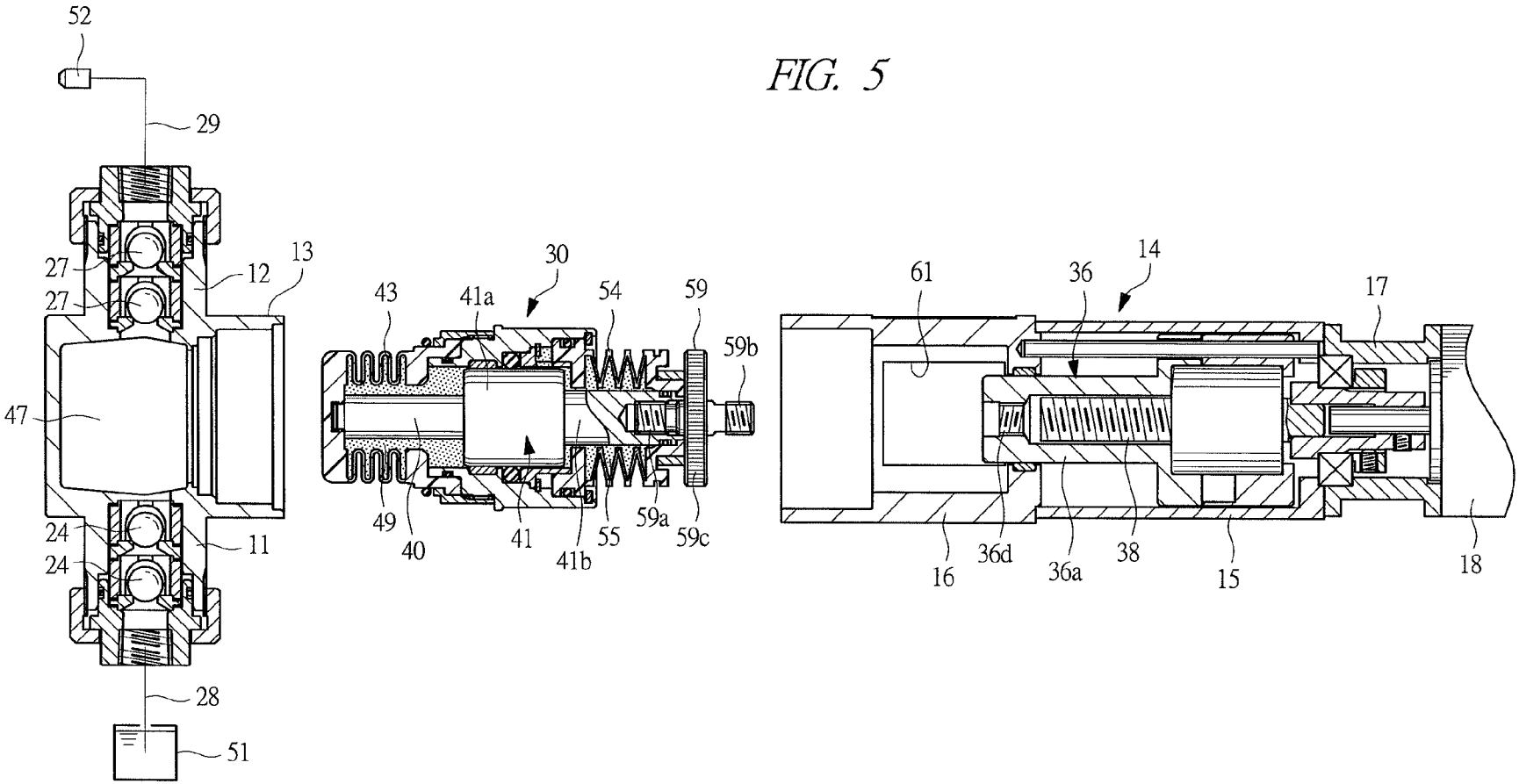
FIG. 5 is an exploded sectional view of the chemical liquid supplying apparatus.

Hereinafter, embodiments according to the present invention will be described in detail with reference to the accompanying drawings. FIG. 1 is a perspective view showing external appearance of a chemical liquid supplying apparatus according to an embodiment of the present invention; FIG. 2 is a plane view of the chemical liquid supplying apparatus viewed from an arrow 2 in FIG. 1; FIG. 3 is an enlarged sectional view showing a portion of a front-side half of FIG. 1; FIG. 4 is an enlarged sectional view showing a rear-side half of FIG. 1; and FIG. 5 is an exploded sectional view of the chemical liquid supplying apparatus.

A chemical liquid supplying apparatus 10 has, as shown in FIG. 1, a substantially rectangular parallelepiped-shaped pump case 13 provided integrally with a liquid inflow portion 11 and a liquid discharge portion 12, each of which is formed into a cylindrical shape, and this pump case 13 is detachably mounted on a drive unit 14. The drive unit 14 has a substantially rectangular parallelepiped-shaped unit housing 15, and a substantially rectangular parallelepiped-shaped connection case 16 fixed to a tip portion of the unit housing. An electric motor 18 is attached to a rear end of the unit housing 15 via an adapter 17. As shown in FIG. 1, the electric motor 18 is fastened to the adapter 17 by bolts 19*a*, which is attached to a flange portion located on a rear end side of the adapter 17; the unit housing 15 is fastened to the adapter 17 by bolts 19*b*, which is attached to a flange portion located on a tip side of the adapter 17; and the connection case 16 is fastened to a tip surface of the unit housing 15 by bolts 19*c*. The pump case 13 is fastened to the tip surface of the connection case 16 by bolts 20 inserted from a tip surface side of the pump case 13, so that when the bolts 20 are loosen, the pump case 13 is detached from the drive unit 14.

As shown in FIG. 1, the chemical liquid supplying apparatus 10 is constituted linearly and in series from the pump case 13 to the electric motor 18, and a side of the pump case 13 will be called a "tip portion" of the chemical liquid supplying apparatus 10 while a side of the electric motor 18 is will be called a "base end portion" or "rear end portion" of the chemical liquid supplying apparatus 10.

Inside the pump case 13, as shown in FIG. 3, an accommodating chamber 21 whose base end portion side is opened is formed. The liquid inflow portion 11 communicates with the accommodating chamber 21 via a liquid inflow port 11*a* of the pump case 13, and the liquid discharge portion 12 communicates with the accommodating chamber 21 via a liquid discharge port 12*a* of the pump case 13. A connector 22 is fastened to the liquid inflow portion 11 by a setscrew 23, and a supply-side flow path not shown is connected to the connector 22. Incorporated in the liquid inflow portion 11 are two check valves 24, each of which permits flow of chemical liquid from the supply-side flow path to the accommodating chamber 21 and blocks reverse-directional flow. A connector 25 is fastened to the liquid discharge portion 12 by a setscrew 26, and a discharge-side flow path not shown is connected to the connector 25. Incorporated in the liquid discharge portion 12 are two check valves 27, each of which permits flow of the chemical liquid from the accommodating chamber 21 to the discharge-side flow path and blocks reverse-directional flow.

Inside the pump case 13, as shown in FIG. 3, a pump assembly 30 is detachably mounted. Incorporated in the unit housing 15 is a power conversion mechanism for converting rotary motion of the motor shaft to pump movement directed toward a linear direction of the pump assembly 30 by using the electric motor 18 as a drive source. As shown in FIG. 4, a motor shaft 31 is fixed by a fixation screw 34 to a cylindrical joint 33 rotatably supported by a bearing 32 in the adapter 17, and a nut 35 which abuts on the bearing 32 to prevent a deviation to an axial direction of the joint 33 is fixed to the joint 33 by a fixation screw 34*a*. A drive shaft 36 is mounted axially reciprocably inside the unit housing 15, and the drive shaft 36 has a hollow shaft portion 36*a* and a flange portion 36*b* provided integrally with a base end portion of the hollow shaft portion, wherein a tip portion of the hollow shaft portion 36*a* projects into the connection case 16. A plurality of guide rods 37 provided in the unit housing 15 penetrate through the flange portion 36*b*, and axial-directional movement of the drive shaft 36 is guided by the guide rods 37. A ball nut 39, which is screwed to a threaded shaft 38 fixed to the joint 33, is fixed to the drive shaft 36 by a fixing metal fitting 36*c* fastened to the flange portion 36*b*, and the guide rods 37 also penetrate through the fixing metal fitting 36*c*. Rotation of the motor shaft 31 is converted to linear motion of the drive shaft 36 through the ball nut 39 by the ball screw shaft 38. As shown in FIG. 3, mounted in the connection case 16 is an annular guide 16*a* that axially reciprocably supports the hollow shaft portion 36*a*.

As shown in FIG. 3, the pump assembly 30 has a cylindrical body 42 into which a piston 41 is axially slidably incorporated, and an axially elastically-deformable pump bellows, that is, a bellows 43 is attached to a tip portion of the cylindrical body 42. The bellows 43 has: a disk portion 43*a* on its tip side; an annular portion 43*b* on its base end side; and an elastically deformable accordion portion 43*c* therebetween, wherein a cylindrical fitting portion 43*d* projecting from the annular portion 43*b* toward its rear end is fitted in a tip portion 42*a* of the cylindrical body 42. The bellows 43 is attached to the tip portion 42*a* of the cylindrical body 42 by a setscrew 44 which abuts on the fitting portion 43*d* and is screwed into the cylindrical body 42. Incidentally, although an inner circumferential surface and an outer circumferential surface of the cylindrical body 42 are both formed circularly, a shape of the cylindrical body 42 is not limited to a cylinder and may be a polygon.

The piston 41 has a piston main body portion 41*a* and a base end portion 41*b* with a diameter smaller than that of the piston main body portion. A wear ring 45 is mounted inside the cylindrical body 42, and the piston main body portion 41*a* has a sliding surface 46 that is slid on and contacts with an inner circumferential surface of the wear ring 45 and the inner circumferential surface of the cylindrical body 42. However, the wear ring 45 may not be mounted in the cylindrical body 42 in some cases. A tip of the piston 41 is provided with a connection rod 40 for coupling the piston 41 and the disk portion 43*a* constituting a tip portion of the bellows 43, wherein this connection rod 40 is smaller in outer diameter than the piston main body portion 41*a*. The connection rod 40 may be formed integrally with the piston 41, and the connection rod 40 may be attached to the piston 41.

A pump chamber 47, which communicates with the liquid inflow port 11*a* and the liquid discharge port 12*a* outside the bellows, is partitioned and formed by the bellows 43, and a drive chamber 49, in which an incompressible indirect medium 48 consisting of liquid such as oil is enclosed, is formed inside the bellows 43. Therefore, when the piston 41 moves forward in a direction of the disk portion 43*a*, the bellows 43 is elastically deformed in a direction of expanding axially to contract the pump chamber 47. Contrary to this, when the piston 41 is moved backward, the bellows 43 is elastically deformed in a direction of contracting axially to expand the pump chamber 47. As shown in FIG. 5, the supply-side flow path 28 for guiding chemical liquid such as resist liquid accommodated in a chemical liquid tank 51 is connected to the liquid inflow portion 11, and when the pump chamber 47 expands, the chemical liquid flows from the liquid inflow portion 11 into the pump chamber 47 via the check valve 24. On the other hand, the discharge-side flow path 29 provided with a nozzle 52 is connected to the liquid discharge portion 12, and when the pump chamber 47 contracts, the chemical liquid in the pump chamber 47 is discharged from the liquid discharge portion 12 to the nozzle 52 via the check valve 27.

As shown in FIG. 3, a seal member 53*a* is sandwiched between a stepped portion of the pump case 13 and an end face of the setscrew 44 in order to prevent a leakage of the chemical liquid from the pump chamber 47. Sandwiched between the cylindrical fitting portion 43*d* of the bellows 43 and the tip portion 42*a* of the cylindrical body 42 is a seal member 53*b* for preventing a leakage of the indirect medium 48 present in the drive chamber 49.

Attached between the small-diameter base end portion 41*b* of the piston 41 and the cylindrical body 42 is a bellows cover 54 as a flexible cover member that is axially elastically deformable. An interior of the bellows cover 54 continues with the sliding surface 46 of the piston 41 and serves as a seal chamber 55 in which the incompressible indirect medium 48*a* is enclosed. If the base end portion 41*b* is set to have the same diameter as that of the piston main body portion 41*a*, an outer diameter of the bellows cover 54 becomes large. However, by making the base end portion 41*b* smaller in diameter than the piston main body portion 41*a*, the outer diameter of the bellows cover 54 can be made small. Incidentally, an indirect medium of the same kind as that of the indirect medium 48 to be enclosed in the drive chamber 49 is used as an indirect medium 48*a* to be enclosed in the seal chamber 55, but the indirect medium 48 and the indirect medium 48*a* may be different from each other in kind of liquid.

The bellows cover 54 includes: fixing ring portions 54*a* and 54*b* located respectively on its tip side and its rear end side; and a accordion portion 54*c* therebetween. The fixing ring portion 54*a* is incorporated inside the cylindrical body 42, and its tip surface abuts on a stepped portion of the cylindrical body 42 and is fixed to the cylindrical body 42 by a snap ring 56*a*. The fixing ring portion 54*a* is fitted outside a cylindrical portion of a retainer 57 fixed inside the cylindrical body 42 by a snap ring 56*b*. Formed in the cylindrical portion of the retainer 57 is a through hole 57*a* for communicating with an interior and an exterior of the retainer so that indirect medium 48*a* is moved from inside the retainer 57 to the outside. A seal member 53*c* for preventing a leakage of the indirect medium 48*a* from the region between the fixing ring portion 54*a* and the cylindrical body 42 is mounted in an annular groove formed in an outer circumferential surface of the fixing ring portion 54*a*. To prevent a leakage of the indirect medium 48*a* from the region between the fixing ring portion 54*b* and the base end portion 41*b*, a seal member 53*d* is mounted in an annular groove formed in the base end portion 41*b*.

Mounted between the stepped portion formed on the cylindrical body 42 and the retainer 57 is a seal member 58, which contacts with the outer circumferential surface of the piston 41 and seals a region between the cylindrical body 42 and the piston 41. This seal member 58 is slid on and contacts with the sliding surface 46 of the piston main body portion 41*a* of the piston 41 that reciprocates. However, the present embodiment may have a structure of forming an annular groove in the outer circumferential surface of the piston main body portion 41*a* and of mounting the seal member 58 into the annular groove. In this case, the seal member 58 is slid on and contacts with the inner circumferential surface of cylindrical body 42 during reciprocation of the piston 41. Used as the seal member 58 is an O-ring whose cross-sectional shape is circular similarly to the seal members 53*a* and 53*b*. However, another type of seal member such as a seal member whose cross section is different from a circle may be used.

In order to couple the piston 41 to the hollow shaft portion 36*a* of the drive shaft 36, a connecting member 59 is attached to the base end portion 41*b* of the piston 41. One end portion of the connecting member 59 is provided with a screw shaft portion 59*a* attached to the base end portion 41*b*, the other end portion thereof is provided with a screw shaft portion 59*b* attached to the hollow shaft portion 36*a*, and a center portion thereof is provided with an operating knob 59*c* having a disk shape larger in diameter than the screw shaft portions 59*a* and 59*b*. The pump assembly 30 is coupled to the drive shaft 36 by the connecting member 59, and the drive shaft 36 that reciprocates axially by rotation of the motor shaft 31 drives the piston 41 via the connecting member 59.

The accordion portion 43*c* of the bellows 43 has an inside portion, an outside portion, and a radial portion therebetween, wherein each of the inside and outside portions is formed into an arc cross sectional shape. In contrast, the accordion portion 54*c* of the bellows cover 54 has an inside portion, an outside portion, and a radial portion therebetween, wherein each of the inside and outside portions is formed into a substantially square cross sectional shape. However, a cross-sectional shape of the accordion portion 43*c* used as the bellows 43 may be similar or identical to that of the accordion portion 54*c*, and a cross-sectional shape of the accordion portion 54*c* used as the bellows 54 may be similar or identical to that of the accordion portion 43*c*.

The bellows 43 is formed of tetrafluoroethylene perfluoroalkyl vinyl ether copolymer (PFA) which is a fluoric resin. However, a material of the bellows 43 is not limited to PFA, and flexible materials such as other resin materials, rubber materials, or metal materials may be used as a material of the bellows 43 so long as they are elastically deformable. The bellows cover 54 is formed of PFA, but any kinds of materials may be used in the same manner as the bellows 43 so long as they are elastically deformable. When the chemical liquid is resist liquid, a material which does not react with the resist liquid is desirably used as a material of a portion which the chemical liquid contacts with, for example, a material of the pump case 13 and the like.

Because the accordion portion 43*c* of the bellows 43 snakes radially, a dimension of its inner diameter is different due to its axial location. If an average effective diameter of the axial-directional entirety of the accordion portion 43*c* is defined as "D1", this average effective diameter D1 is set to be almost the same as an outer diameter "D2" of the sliding surface 46 of the piston main body portion 41*a* (D1=D2). Therefore, an average effective area of the accordion portion 43*c* and a cross-sectional area of the piston 41 are set to have almost the same value, and when the piston 41 is axially reciprocated and the accordion portion 43*c* of the bellows 43 is elastically deformed axially, a volume of the drive chamber 49 becomes constant. For this reason, during the reciprocation of the piston 41, the accordion portion 43*c* of the bellows 43 is deformed only axially, but is not deformed radically.

Involved in a dimension of approximately the same diameter as the average effective diameter D1 with respect to the outer diameter D2 is a permissible error so long as the permissible error is in such a degree that durability of the bellows 43 is not lost even if the accordion portion 43*c* is deformed slightly radially during the axial-directional reciprocation of the piston 41. A gap between the sliding surface 46 of the piston 41 and the inner circumferential surface of the cylindrical body 42 is set small, for example, at 0.5 mm or less, and even if the average effective diameter D1 of the accordion portion 43*c* is set to be the same diameter as that of the inner circumferential surface of the cylindrical body 42, the accordion portion 43*c* is hardly deformed radially during the reciprocation of the piston 41, whereby the durability of the bellows 43 can be maintained. Therefore, a dimension of the inner diameter of the cylindrical body 42 is also included in a permissible error of the outer diameter D2.

If an average effective diameter of the axial-directional entirety of the accordion portion 54*c* of the bellows cover 54 is defined as "D3" in the same manner as the bellows 43, this average effective diameter D3 is set to be approximately the same as the outer diameter D2 of the sliding surface 46 of the piston 41 (D1=D2=D3). Therefore, an average effective area of the accordion portion 54*c* and a cross-sectional area of the piston 41 are set to have almost the same value, and when the piston 41 is reciprocated axially and the accordion portion 54*c* of the bellows cover 54 is elastically deformed axially, the volume of the seal chamber 55 becomes constant. Therefore, the accordion portion 54*c* is deformed only axially during the reciprocation of the piston 41, but is not deformed radially. Involved in a dimension of approximately the same diameter as the average effective diameter D3 with respect to the outer diameter D2 is a permissible error in the same manner as the accordion portion 53*c* so long as the permissible error is in such a degree that the durability of the bellows cover 54 is not lost even if the accordion portion 54*c* is deformed slightly radially during the axial-directional reciprocation of the piston 41.

Because the piston 41 is connected to the disk portion 43*a* of the bellows 43 by the connection rod 40, the tip portion of the bellows 43 is prevented from being displaced downward by its own weight and from inclining due to flow of the chemical liquid in the pump chamber 47. In addition, a movement stroke of the piston 41 and an expansion/contraction stroke of the bellows 43 can be precisely caused to coincide with each other, so that the accordion portion 43*c* is prevented from being partially dented or expanded, whereby uneven expansion or contraction of the accordion portion 43*c* can be prevented from occurring. Therefore, it is possible to improve the durability of the bellows 43.

In this chemical liquid supplying apparatus 10, the indirect medium 48 in the drive chamber 49 is pressurized by the piston 41, and the bellows 43 is axially expanded and contracted, so that it is possible to increase pressure of the drive chamber 49. The indirect medium 48 in the drive chamber 49 is sealed by the seal member 58, but when the drive chamber 49 is pressurized by the piston 41 to increase the pressure of the pump chamber 47, there is the fear that the indirect medium 48 adhering to the outer circumferential surface of the piston 41, that is, the sliding surface 46 penetrates through the extremely slight gap between the seal member 58 and the sliding surface 46 by the pressure of the drive chamber 49 and leaks out toward an opening end of the cylindrical body 42. In other words, when the piston 41 is driven in a direction of discharging the chemical liquid, the bellows 43 expands via the indirect medium 48 of the drive chamber 49, whereby the volume of the pump chamber 47 becomes small. At this moment, pressure occurs in the pump chamber 47 due to viscosity and a flow rate of the chemical liquid, and liquid-discharge side resistance of the liquid discharge port 12*a*, pipes connected thereto, and the like, and since the pressure is transmitted to the indirect medium 48 via the bellows 43, the pressure in the drive chamber 49 is increased.

However, even if the indirect medium 48 adhering to the outer circumferential surface of the piston main body portion 41*a* leaks out to the outside due to an increase of the pressure of the drive chamber 49, the indirect medium 48 that has leaked out is taken in by the indirect medium 48*a* present in the seal chamber 55, thereby not leaking out to the outside of the apparatus. Because the bellows cover 54 has no sliding portion, the indirect medium 48 which has leaked out from the region between the piston 41 and the wear ring 45 can be prevented from leaking out or being scattered from the seal chamber 55 to the outside.

When the piston 41 is moved backward to enlarge the volume of the pump chamber 47, even if the indirect medium 48 in the drive chamber 49 becomes in a negative pressure state, the base end portion 41*b* of the piston 41 has been blocked by the bellows cover 54 from the outside, so that even if the indirect medium 48*a* enclosed in the seal chamber 55 flows back and enters into the drive chamber 49, external air is not mixed into the drive chamber 49. Further, because the indirect medium 48 such as liquid is larger in molecular weight than gas, it is difficult for such an indirect medium to pass through the slight gap between the seal member 58 and the sliding surface 46, whereby an amount of the indirect medium 48*a* that enters from the seal chamber 55 into the drive chamber 55 becomes small. Thus, by enclosing the indirect medium 48*a* such as liquid into the seal chamber 55, discharge precision of the chemical liquid from the liquid discharge port 12*a* is highly maintained for a long time. In other words, although exterior circumambient air may enter into the drive chamber in Patent Document 4, exterior circumambient air does not enter into the drive chamber in the present invention.

Furthermore, when the seal member 58 for sealing a region between the sliding surface 46 of the piston 41 and the inner circumferential surface of the cylindrical body 42 is regarded as a boundary, because the incompressible indirect media 48 and 48*a* are filled on both axial-directional sides of the boundary, the indirect media 48 and 48*a* whose shapes have been thin films interpose between the seal member 58 and the outer circumferential surface of the sliding surface 46, so that a lubrication characteristic of the seal member 58 is increased, which results in prevention of abrasion of the seal member 58. Therefore, the durability of the seal member 58 is improved, and service life of the apparatus can be lengthened.

In addition, even if abrasion of the seal member 58 in long usage causes deterioration of its sealing characteristic, it is possible to prevent air from being mixed in the drive chamber 49 and to make the reciprocating stroke of the piston 41 correspond to, with high precision, the discharge amount of the chemical liquid determined by the elastic deformation of the bellows 43. Therefore, when photoresist liquid is applied to a glass substrate for liquid crystal display device, it is possible to discharge a fixed amount of photoresist liquid from the nozzle 52 with high precision.

Figure 6A:
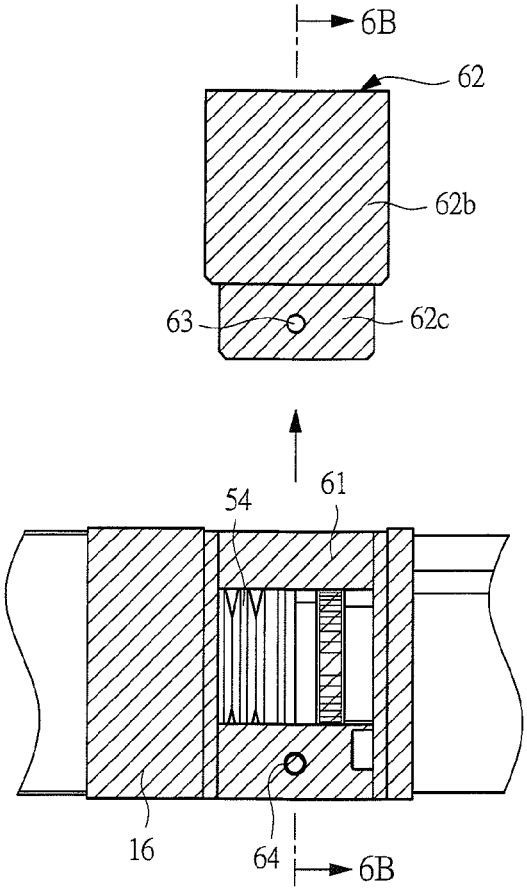
FIG. 6A is a side view showing a connection case of the chemical liquid supplying apparatus.
Figure 6B:
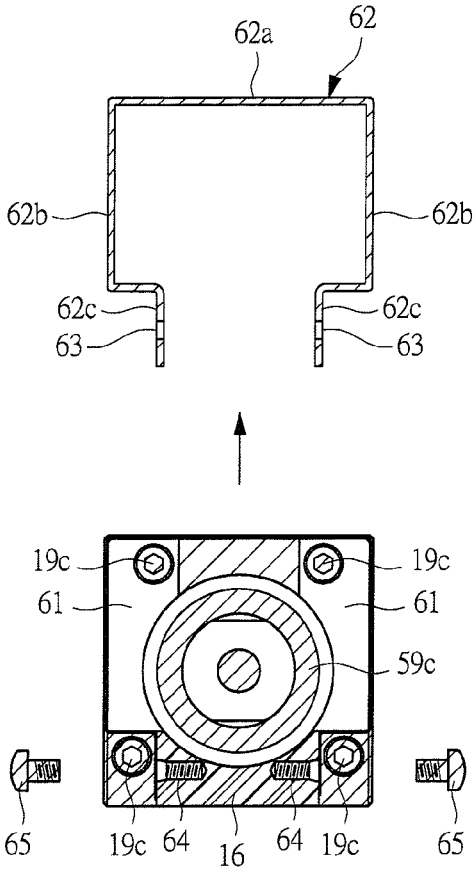
FIG. 6B is a sectional view taken along the line 6B-6B in FIG. 6A.

FIG. 6A is a side view showing the connection case 16, and FIG. 6B is a sectional view taken along the line 6B-6B in FIG. 6A.

When the pump assembly 30 is replaced with a new one and/or maintenance of the pump assembly 30 is performed, as shown in FIG. 5, the pump assembly 30 is detached from the chemical liquid supplying apparatus 10 by separating the pump case 13 and the drive unit 14. At this moment, the operating knob 59*c* is operated to rotate the connecting member 59 together with the pump assembly 30, whereby the screwing between the screw shaft portion 59*b* and a female screw portion 36*d* of the drive shaft 36 is released to separate the piston 41 from the drive shaft 36.

In order to easily perform work of separating the piston 41 and the drive shaft 36, as shown in FIG. 6, an opening window 61 is formed in a side wall of the connection case 16 corresponding to a location of the operating knob 59*c* of the connecting member 59, and the operating knob 59*c* is exposed to the outside via the opening window 61. A cover 62 for covering the opening window 61 is detachably mounted onto the connection case 16. The cover 62 has a front wall 62*a* for covering the a front surface of the connection case 16, and side walls 62*b* for covering both side faces thereof, wherein a cross-sectional shape of the cover is approximately a U-shape. Tips of the side walls 62*b* are provided with tongue portions 62*c* in which through holes 63 are formed, and screw holes 64 are formed in the connection case 16 correspondingly to the through holes 63, whereby the cover 62 is fastened by screw members 65 to be screwed into the screw holes 64.

FIGS. 6A and 6B each show a state where the cover 62 is detached from the connection case 16 to expose the operating knob 59*c* to the outside. When the operating knob 59*c* is rotated in the above state, the connecting member 59 can be separated from the drive shaft 36. Therefore, by rotating the operating knob 59*c* in a state where the pump case 13 is detached from the connection case 16 without detaching the connection case 16 from the unit housing 15, it is possible to easily take out the pump assembly 30 from inside the connection case 16 and to assemble the pump assembly 30 into the pump case 13.

In performing operations of detaching and assembling the pump assembly 30 from and into the connection case 16 and/or the pump case 13, the indirect medium 48 is enclosed in the drive chamber 49 of the bellows 43, and the indirect medium 48*a* is enclosed in the seal chamber 55 of the bellows cover 54. Therefore, the indirect media 48 and 48*a* do not flow out to the outside, whereby the liquid does not adhere to hands of operators nor is scattered around the apparatus. In addition, because the pump assembly 30 can be attached and detached as one unit, the pump assembly 30 can be easily replaced in a short time, so that it is possible to shorten a pump-stop time on a production line equipped with the chemical liquid supplying apparatus 10.

As shown in FIG. 1, a sensor attachment groove 66 is formed in a side face of the unit housing 15 so as to extend in a longitudinal direction, and a magnetic sensor 67 is mounted in the sensor attachment groove 66. This magnetic sensor 67 senses, as shown in FIG. 4, a magnetic force of a magnet 68 attached to the drive shaft 36 and outputs signals. The magnetic sensor 67 is used to detect whether the drive shaft 36 has reached its origin position, that is, a reference position. Therefore, by the signals from the magnetism sensor 67, a linear reciprocation stroke of the drive shaft 36 can be made constant. Incidentally, two magnetic sensors 67 may be mounted in the sensor attachment groove 66 correspondingly to a forward limit position and a backward limit position of the drive shaft 36.

When an optical sensor having a light emitting element and a light receiving element is used to detect the origin position of the drive shaft 36, a connection terminal of the sensor is exposed inside the drive unit 14, so that if the bellows 43 and/or the bellows cover 54 are damaged and the liquid flows in the drive unit 14, there is the fear that the liquid is scattered to connection electrodes and the like of the sensor. For this reason, when flammable liquid is used as the indirect medium, there is danger of catching fire from the connection electrode by the liquid scattered to the connection electrodes. In contrast, when the magnetic sensor 67 is used as an origin sensor, the magnetic sensor 67 can be attached to the outer surface of the drive unit 14, so that the magnetic sensor 67 is isolated from inside the drive unit 14 by the partition wall of the unit housing 15. Therefore, the chemical liquid supplying apparatus which can be used safely is obtained.

When the chemical liquid supplying apparatus is used to discharge the chemical liquid present in the chemical liquid tank 51 from the nozzle 52, the chemical liquid supplying apparatus 10 is usually installed at a horizontal supporting base, as shown in FIG. 1, by a screw member screwed into a screw hole 72 that is formed in a back surface of the connection case 16. Thus, when the chemical liquid supplying apparatus 10 is installed horizontally, the chemical liquid flows vertically from the chemical liquid tank 51 toward the nozzle 52, so that even if air bubbles are included in the chemical liquid flowing from the chemical liquid tank 51 to the nozzle 52, the air bubbles are prevented from being caught by the pump chamber 47 and the check valves 24 and 27.

Since this chemical liquid supplying apparatus 10 is constituted to be arranged linearly and in series from the pump case 13 to the electric motor 18, a width dimension thereof is small, whereby any other appliances can be arranged in limited spaces located on both sides of the chemical liquid supplying apparatus 10.

In order to discharge the chemical liquid from the nozzle 52, repeated are the following operations, that is, an operation of moving, by rotating the motor shaft 31 of the electric motor 18, the piston 41 backward to make the chemical liquid in the chemical liquid tank 51 suck in the pump chamber 47; and an operation of moving, by rotating the motor shaft 31 reversely, the piston 41 forward to make the chemical liquid in the pump chamber 47 discharge toward the nozzle 52. A forward movement stroke of the piston 41 is set by rotating the motor shaft 31 only up to the predetermined number of revolutions from the origin position of the piston 41, which is detected by the magnetic sensor 67, and the drive shaft 36.

The bellows 43 expands and contracts axially by the forward and backward movement of the piston 41, the pump chamber 47 expands and contracts, at the volume corresponding to the expansion and contraction of the bellows, to perform a pump operation. During this pump operation, because the bellows 43 expands and contracts via the indirect medium 48 enclosed in the drive chamber 49, the bellows 43 is not deformed radially by the indirect medium 48 and is elastically deformed axially at a stroke corresponding to the movement stroke of the piston 41 while maintaining its average radius. Therefore, the amount of chemical liquid corresponding to the movement stroke of the drive shaft 36 can be discharged from the nozzle 52. Even if the indirect medium 48 in the drive chamber 49 leaks via the seal member 58 into the seal chamber 55, because the seal chamber 55 is blocked from the outside by the bellows cover 54, the indirect media 48 and 48*a* can be prevented from leaking out to the outside.

When the pump assembly 30 is replaced due to deterioration and the like of the seal member 58, the pump assembly 30 is detached from the pump case 13 and the connection case 16. In this detaching work, while the pump case 13 is separated from the drive unit 14, the connecting member 59 is rotated by the operating knob 59*c* from the opening window 61 to release the connection between the connecting member 59 and the drive shaft 36, whereby the pump assembly 30 which has been unitized can be taken out in a short time. At this moment, since the liquid inside the pump assembly 30 is sealed, the liquid does not adhere to the hands of the operators nor is scattered around the apparatus.

Figure 7:
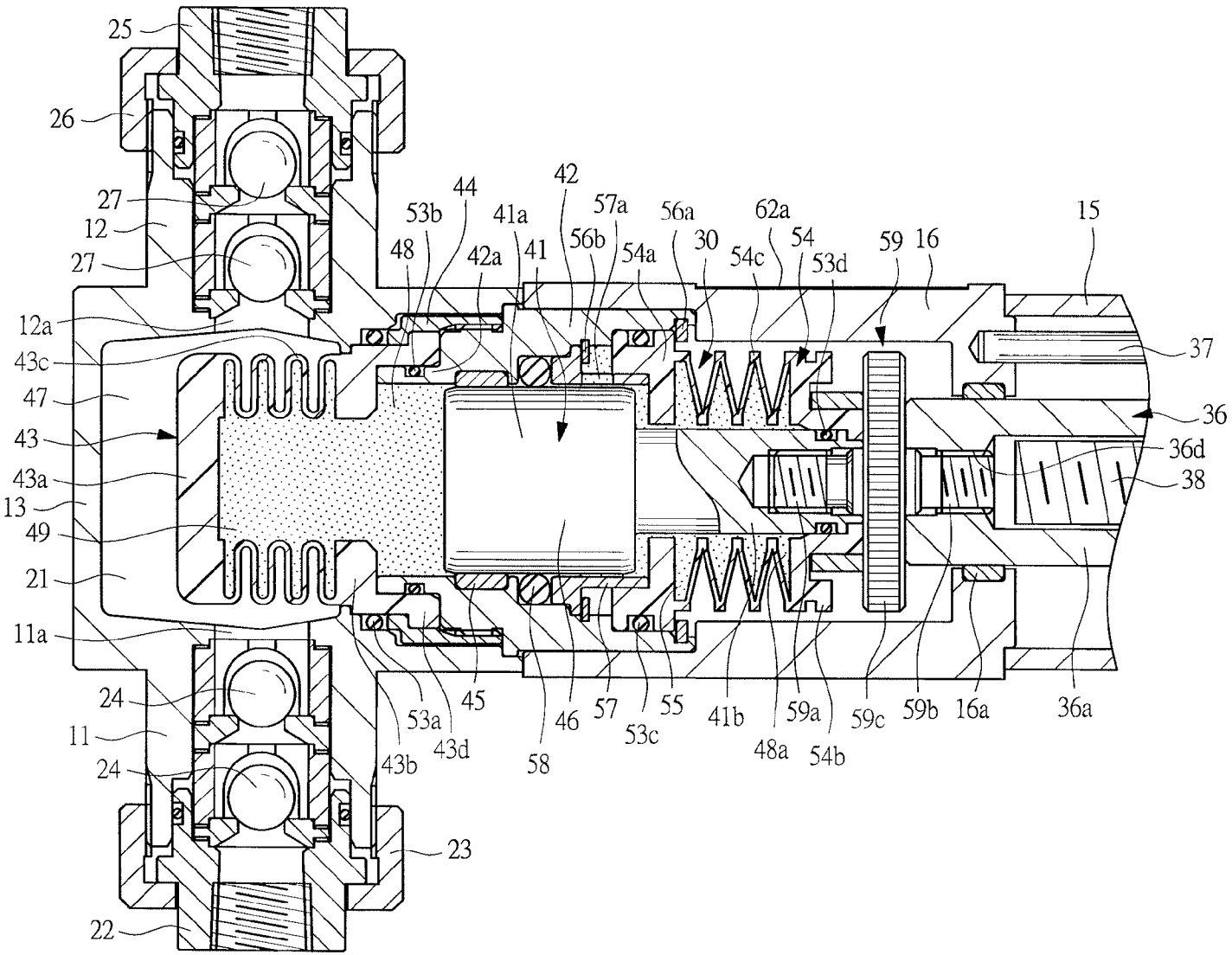
FIG. 7 is a sectional view showing a portion of a chemical liquid supplying apparatus according to another embodiment of the present invention, and shows the same portion as that of FIG. 3 which illustrates the above-mentioned chemical liquid supplying apparatus.
Figure 8:
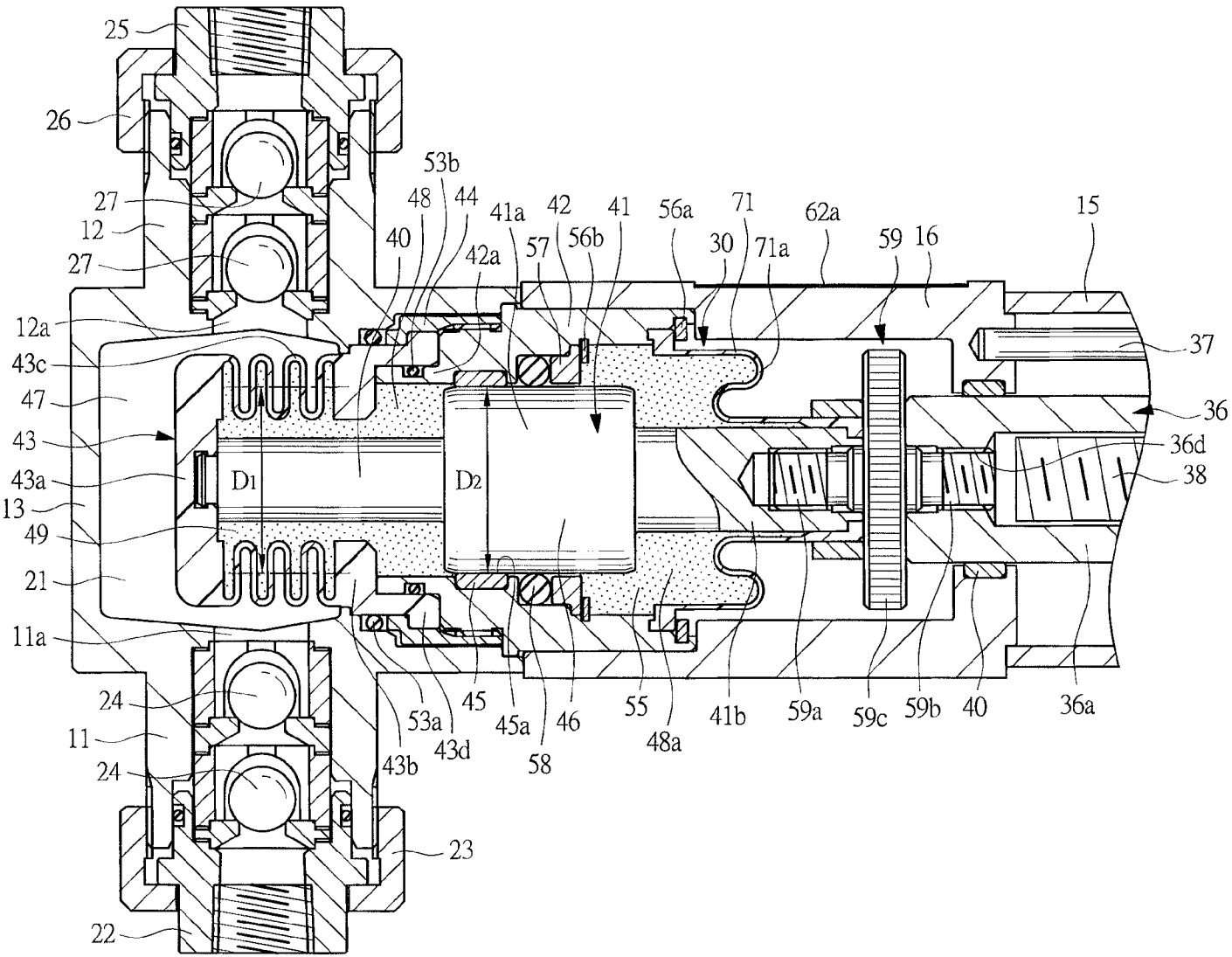
FIG. 8 is a sectional view showing a portion of a chemical liquid supplying apparatus according to a still another embodiment of the present invention, and shows the same portion as that of FIG. 3 which illustrates the above-mentioned chemical liquid supplying apparatus.

FIGS. 7 and 8 are sectional views each showing a portion of a chemical liquid supplying apparatus according to another embodiment of the present invention, and portions similar to those of FIG. 3 showing the chemical liquid supplying apparatus mentioned above are illustrated in FIGS. 7 and 8. In FIGS. 7 and 8, the same reference numerals are denoted to components common to those in the above-mentioned chemical liquid supplying apparatus, and repetitive explanation thereof will be omitted.

In the chemical liquid supplying apparatus 10 shown in FIG. 7, without connecting the piston 41 and the disk portion 43*a* by the connection rod 40, the axial-directional movement of the piston 41 is converted into the expansion/contraction movement of the bellows 43 only by the indirect medium 48. Thus, the present embodiment may have a structure of not using the connection rod 40 shown in FIG. 3.

In the chemical liquid supplying apparatus 10 shown in FIG. 8, a diaphragm cover 71 as a flexible cover member is attached between the cylindrical body 42 and the base end portion 41*b* of the piston 41, and the seal chamber 55 is formed inside this diaphragm cover 71. The diaphragm cover 71 has a tip portion fixed to the cylindrical body 42; a rear end portion fixed to the base end portion 41*b;* and a curved portion 71*a* which snakes like an S-shaped cross section therebetween, whereby during axial-directional reciprocation of the piston 41, the diaphragm cover 71 is elastically deformed axially to follow the piston 41. Thus, the cover 54 of a bellows type or the cover 71 of a diaphragm type may be used as a flexible cover member for forming the seal chamber 55.

In each chemical liquid supplying apparatus 10, the check valves 24 and 27 are incorporated inside the liquid inflow portion 11 and the liquid discharge portion 12, which are provided in the pump case 13. However, without incorporating the check valves 24 and 27 into the pump case 13, the supply-side flow path 28 and the discharge-side flow path 29, which are connected to the pump case 13, may be provided with the check valves 24 and 27, respectively. In addition, instead of the check valves 24 and 27, solenoid valves for opening and closing a flow path by an electrical signal, motor driven valves, and air operating valves for operating by air pressure may be employed.

The present invention is not limited to the above-described embodiments, and may be variously modified within a scope of not departing from the gist thereof. For example, the piston 41 is driven by the electric motor 18, but a driving means is not limited to the electric motor 18 and may be other means such as an air pressure cylinder.

What is claimed is:

1. A chemical liquid supplying apparatus comprising:

a pump case having a liquid inflow port and a liquid discharge port formed therein;

a cylindrical body mounted in the pump case;

an axially reciprocable piston which is incorporated in the cylindrical body, the piston having a piston main body having a sliding surface which slidably contacts with an inner circumferential surface of the cylindrical body;

an elastically deformable pump bellows attached to a tip portion of the cylindrical body, the pump bellows partitioning and forming a pump chamber communicating with the liquid inflow port and the liquid discharge port in the pump case, the pump bellows partitioning and forming a drive chamber in which an incompressible indirect medium is enclosed between a tip of the piston and the pump bellows;

a flexible cover member elastically deformed axially, attached between a base end portion of the piston and the cylindrical body, the flexible cover member forming a seal chamber which continues with the sliding surface of the piston and in which the incompressible indirect medium is enclosed, the flexible cover member being composed of an axially elastically deformable bellows having an average effective diameter which is substantially identical to an outer diameter of the piston main body; and a drive unit mounted in the pump case, a drive shaft for reciprocating axially the piston being incorporated in the drive unit, wherein the piston base end portion is smaller in diameter than the piston main body.

2. The chemical liquid supplying apparatus according to claim 1, further comprising a connection rod provided to the piston, the connection rod being smaller in diameter than the piston main body, and coupling the piston and a tip portion of the pump bellows.

3. The chemical liquid supplying apparatus according to claim 2, wherein an average effective diameter of the pump bellows is substantially identical to an outer diameter of the piston main body.

4. A chemical liquid supplying apparatus comprising:

a pump case having a liquid inflow port and a liquid discharge port formed therein;

a cylindrical body mounted in the pump case;

an axially reciprocable piston having a piston main body having a sliding surface which slidably contacts with an inner circumferential surface of the cylindrical body, and a connection rod provided to a tip of the piston main body, the connection rod being smaller in diameter than the piston main body, the piston being incorporated in the cylindrical body;

an elastically deformable pump bellows attached between a tip portion of the cylindrical body and a tip of the connection rod, the pump bellows partitioning and forming a pump chamber communicating with the liquid inflow port and the liquid discharge port in the pump case, the pump bellows partitioning and forming a drive chamber in which an incompressible indirect medium is enclosed between a tip of the piston and the pump bellows, the pump bellows having an average effective diameter which is substantially identical to an outer diameter of the piston main body;

a flexible cover member attached between a base end portion of the piston and the cylindrical body, the flexible cover member forming a seal chamber which continues with the sliding surface of the piston and in which the incompressible indirect medium is enclosed, the flexible cover member being elastically deformable axially; and a drive unit mounted in the pump case, a drive shaft for reciprocating axially the piston being incorporated in the drive unit.

5. The chemical liquid supplying apparatus according to claim 4, wherein the flexible cover member is a diaphragm.

6. The chemical liquid supplying apparatus according to claim 1, wherein the base end portion is smaller in diameter than the piston main body.

7. A pump assembly detachably mounted in a pump case having a liquid inflow port and a liquid discharge port formed therein, the pump assembly comprising:

a cylindrical body having an axially slidable piston incorporated therein;

an elastically deformable pump bellows attached to a tip portion of the cylindrical body, the pump bellows partitioning and forming a drive chamber in which an incompressible indirect medium is enclosed between a tip of the piston and the pump bellows; and a flexible cover member attached between a base end portion of the piston and the cylindrical body, the flexible cover member forming a seal chamber which continues with a sliding surface of the piston and in which the incompressible indirect medium is enclosed, the flexible cover member being elastically deformable axially, wherein the pump bellows and the pump case form a pump chamber in a state of being mounted in the pump case, and the piston has a piston main body which slidably contacts with an inner circumferential surface of the cylindrical body, and a base end portion smaller in diameter than the piston main body, the seal chamber being formed between the flexible cover member and the base end portion.

8. A pump assembly detachably mounted in a pump case having a liquid inflow port and a liquid discharge port formed therein, the pump assembly comprising:

a cylindrical body having an axially slidable piston incorporated therein;

an elastically deformable pump bellows attached to a tip portion of the cylindrical body, the pump bellows partitioning and forming a drive chamber in which an incompressible indirect medium is enclosed between a tip of the piston and the pump bellows; and a flexible cover member attached between a base end portion of the piston and the cylindrical body, the flexible cover member forming a seal chamber which continues with a sliding surface of the piston and in which the incompressible indirect medium is enclosed, the flexible cover member being elastically deformable axially, wherein the pump bellows and the pump case form a pump chamber in a state of being mounted in the pump case, and an average effective diameter of the pump bellows is substantially identical to an outer diameter of the piston main body.

9. The pump assembly according to claim 7, wherein the flexible cover member is a bellows, an average effective diameter of this bellows being substantially identical to an outer diameter of the piston main body.

10. The pump assembly according to claim 7, wherein the flexible cover member is a bellows or diaphragm.

11. The chemical liquid supplying apparatus according to claim 4, wherein the base end portion is smaller in diameter than the piston main body.

12. The pump assembly according to claim 8, wherein the flexible cover member is one of a bellows or a diaphragm.

* * * * *